US006722263B2

(12) United States Patent
Keller et al.

(10) Patent No.: US 6,722,263 B2
(45) Date of Patent: Apr. 20, 2004

(54) BOTTOM COVERING OF A COOLING CHAMBER FOR PISTONS OF INTERNAL COMBUSTION ENGINES

(75) Inventors: Klaus Keller, Lorch (DE); Peter Kemnitz, Leutenbach (DE); Roland Lochmann, Marbach (DE)

(73) Assignee: Mahle GmbH, Stuttgart (DE)

( * ) Notice: Subject to any disclaimer, the term of this patent is extended or adjusted under 35 U.S.C. 154(b) by 103 days.

(21) Appl. No.: 10/149,800

(22) PCT Filed: Dec. 5, 2000

(86) PCT No.: PCT/DE00/04358

§ 371 (c)(1),
(2), (4) Date: Jun. 14, 2002

(87) PCT Pub. No.: WO01/44645

PCT Pub. Date: Jun. 21, 2001

(65) Prior Publication Data

US 2002/0178910 A1 Dec. 5, 2002

(30) Foreign Application Priority Data

Dec. 17, 1999 (DE) ..... 199 60 913

(51) Int. Cl.[7] ..... F01B 31/08
(52) U.S. Cl. ..... 92/186; 285/921

(58) Field of Search ..... 92/186, 181 R; 285/921, 192

(56) References Cited

U.S. PATENT DOCUMENTS

| | | | | |
|---|---|---|---|---|
| 3,221,718 A | | 12/1965 | Isley | 92/186 |
| 3,844,588 A | * | 10/1974 | Jocsak | 285/921 |
| 4,377,967 A | | 3/1983 | Pelizzoni | 92/186 |
| 5,261,363 A | | 11/1993 | Kemnitz | 92/186 |

FOREIGN PATENT DOCUMENTS

| | | |
|---|---|---|
| AT | 529 170 | 5/1983 |
| CH | 348 574 | 8/1960 |
| DE | 91 162 | 7/1972 |
| DE | 37 33 965 | 5/1993 |
| DE | 44 10 141 | 9/1995 |
| DE | 42 08 037 | 3/1998 |

* cited by examiner

*Primary Examiner*—F. Daniel Lopez
(74) *Attorney, Agent, or Firm*—Collard & Roe, P.C.

(57) ABSTRACT

The aim of the invention is to provide an easy fastening of a tubular supply or a vertical pipe in a bottom covering of a cooling chamber for pistons of internal combustion engines, e.g. in a circular covering of a cooling channel of an articulated-skirt piston. To this end, the vertical tube or the tubular supply is clipped into the bottom covering or is fastened thereto by a detent connection.

4 Claims, 2 Drawing Sheets

Figure 1:
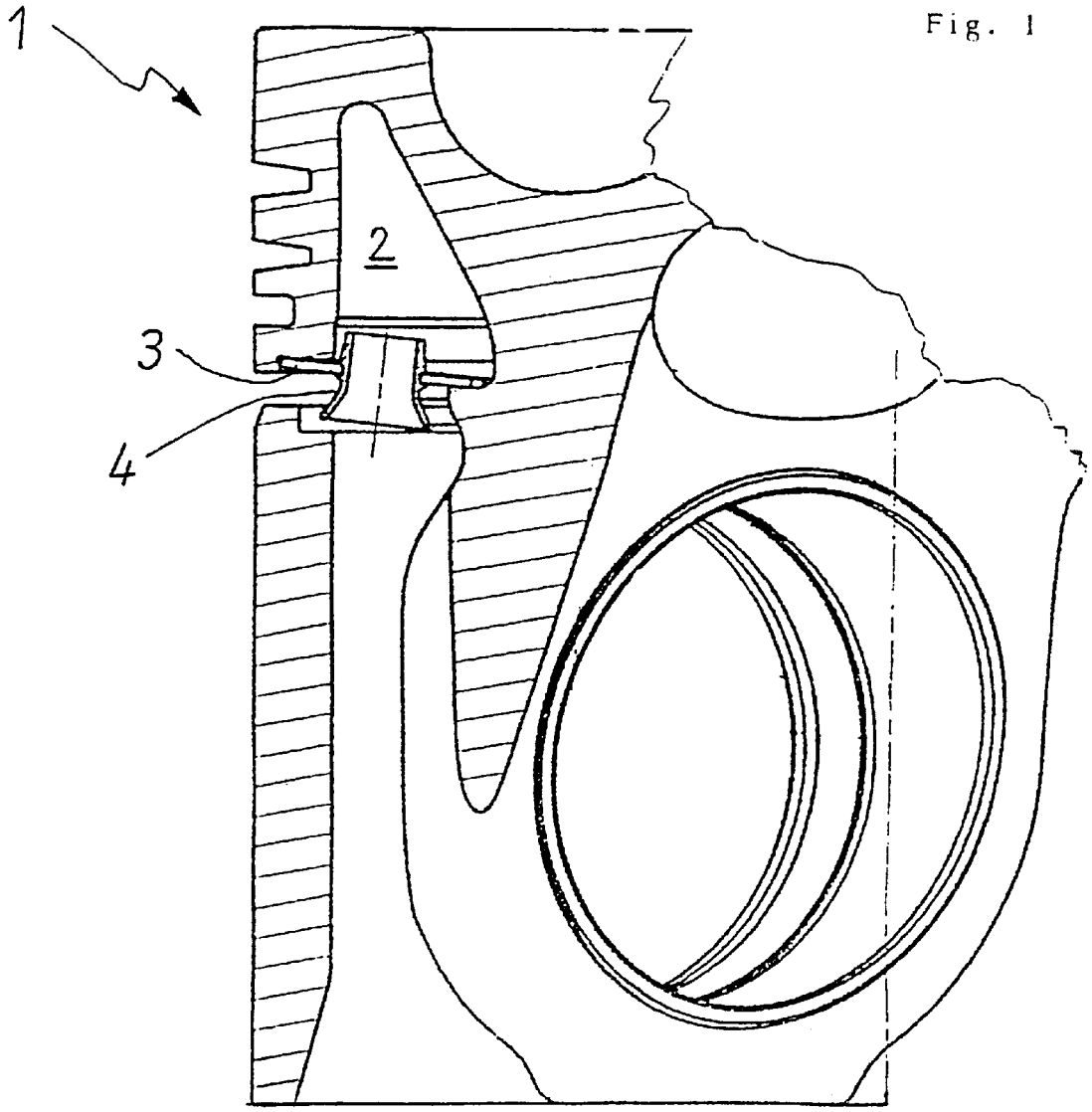

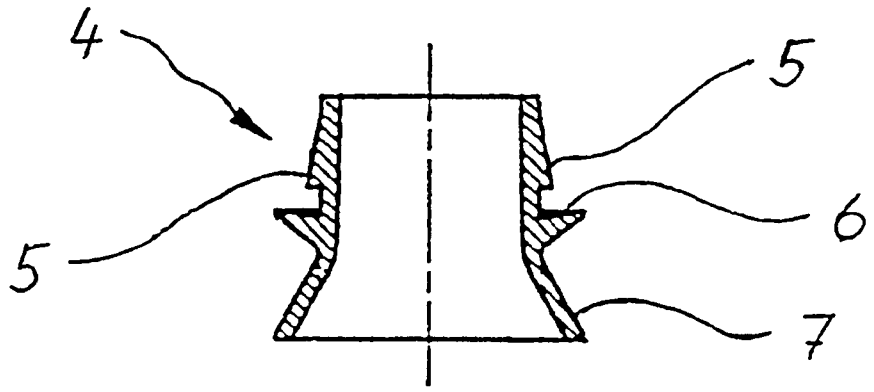
Fig. 2
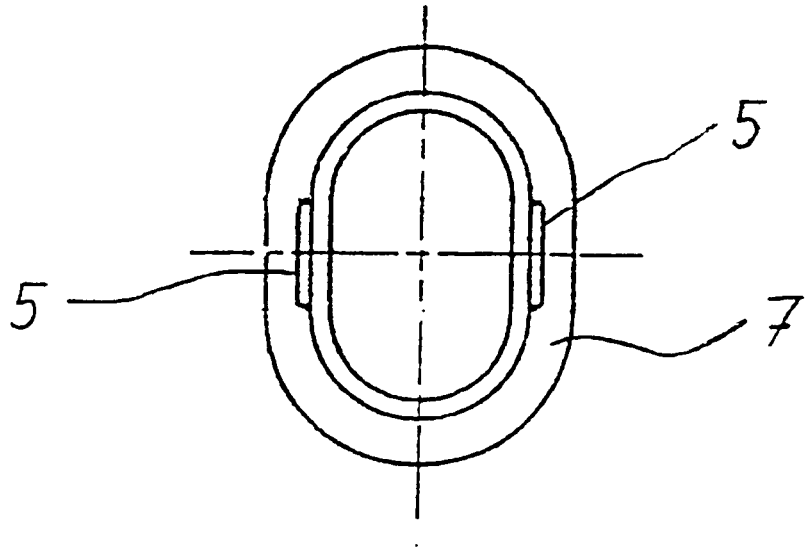

BOTTOM COVERING OF A COOLING CHAMBER FOR PISTONS OF INTERNAL COMBUSTION ENGINES

CROSS REFERENCE TO RELATED APPLICATIONS

Applicants claim priority under 35 U.S.C. §119 of German Application No. 199 60 913.6 filed Dec. 17, 1999. Applicants also claim priority under 35 U.S.C. §120 of PCT/DE00/04358 filed Dec. 5, 2000. The international application under PCT article 21(2) was not published in English.

The invention relates to a bottom covering of a cooling chamber for pistons of internal combustion engines having a tubular inlet line.

Such coverings are known, for example from U.S. Pat. No. 4,377,967 A or DD-PS 91162. FIGS. 4 and 5 of U.S. Pat. No. 4,377,967 show a vertical tube 38 that is expected to assure a defined filling level above the covering or in the pan 70. The vertical tube is made of metal and is connected with the covering by soldering or welding. In DE-PS 91162, a small injection tube 15 projects both upwards into the cooling channel, and as a tubular feed line downwards in the direction of an oil injector nozzle 17. The type of fastening of the small injection tube on the cooling channel is not visible. It has to be assumed that the small injection tube is connected with the sheet metal cooling channel 13 by welding or soldering as well.

However, welding or soldering a rising tube or feed line to the covering represents a manufacturing step requiring substantial expenditure.

Therefore, the invention deals with the problem of securing a vertical tube or inlet line in a simple manner on a bottom covering of a cooling chamber of a piston. This problem is solved by a detent formed of locking noses interacting with the cover. Advantageous further developments are making the tubular inlet line of plastic and oval.

Locking or clipping a vertical tube or tubular inlet line into the covering provides a very simple and cost-saving type of fastening.

The component to be clipped in is advantageously made of plastic because if plastic is used, the elastically locking components can be molded on at the same time the vertical tube is produced. Plastic injection molding is a useful manufacturing process. For higher stresses, the component to be clipped in can be made of metal as well.

Vertical tubes that have to be clipped in advantageously have a cross section deviating from the circular shape, in particular an oval shape.

The application is especially intended for approximately circular bottom coverings of cooling channels, which, according to DE 4208037 C, are formed by a radially fixed, tensioned cup spring that is divided on its circumference in at least two parts. This cup spring freely rests radially on supports on the inside and outside on axially opposed sides, as shown in the following in FIG. 1.

However, the bottom covering of the cooling chamber may be present also in the form of one piece with the basic body of the piston, for example in connection with welded pistons, in particular in connection with pistons produced by friction welding.

The invention is explained in greater detail in the following with the help of a drawing, in which:

FIG. 1 shows a lower covering of a cooling chamber in a piston as defined by the invention; and FIG. 2 shows a cooling chamber covering that can be clipped into a vertical tube (sectional view; top view).

An articulated-skirt piston 1 has a cooling channel 2 that is closed downwards by a covering 3 in the form of a cup spring that is divided in two parts. A vertical tube 4 that is designed to serve also as a tubular inlet line, is fixed in the covering 3 by being locked into the latter.

When mounted, the vertical tube 4 is pushed into the covering 3 from the bottom. When the tube is inserted, the area comprising the locking noses 5 is elastically deformed inwards, and, as soon as the contact surface 6 abuts the covering 3, elastically moves into the locking position in that the vertical tube 4 engages with the groove the covering 3, said groove being disposed directly underneath the locking noses 5. In its lower area, the vertical tube is widened in the form of a funnel.

What is claimed is:

1. A bottom covering of a cooling chamber for pistons of internal combustion engines comprising approximately circular covering, with a tubular inlet line being fastened on the covering, characterized in that the tubular inlet line is secured on the covering by a detent connection.

2. The bottom covering of a cooling chamber for pistons according to claim 1, characterized in that the tubular inlet line is made of plastic.

3. The bottom covering of a cooling chamber for pistons according to claim 1, characterized in that the cross section of the tubular inlet line deviates from the circular shape.

4. The bottom covering of a cooling chamber for pistons according to claim 3, characterized in that the cross section is oval.

* * * * *